United States Patent [19]

Tabery et al.

[11] Patent Number: 4,993,323

[45] Date of Patent: Feb. 19, 1991

[54] FLUIDIZED BED COMBUSTION OF ALUMINUM SMELTING WASTE

[76] Inventors: Ronald S. Tabery, 1300 Crystal Creek Dr., Austin, Tex. 78746; Ky Dangtran, 8210 Bent Tree Rd., #229, Austin, Tex. 78759

[21] Appl. No.: 345,824

[22] Filed: May 1, 1989

Related U.S. Application Data

[62] Division of Ser. No. 242,526, Sep. 8, 1988, abandoned.

[51] Int. Cl.[5] ..... F23G 5/00; F23G 7/00

[52] U.S. Cl. ..... 110/346; 110/232; 110/245; 110/347

[58] Field of Search ..... 110/345, 346, 347, 232, 110/245

[56] References Cited

U.S. PATENT DOCUMENTS 4,763,585 8/1988 Rickman et al. ..... 110/345 X

*Primary Examiner*—Edward G. Favors

[57] ABSTRACT

An environmentally acceptable and effective method for thermal destruction of Spent Potliner (SPL) by Fluidized Bed Combustion (FBC) has been established. This method has overcome problems associated with ash agglomeration, ash leachate character and emission control, the primary obstacles for applying FBC to the disposal of SPL and like solid fuels. Specifically, "recipes" of appropriate additives (fuel blends) are proposed. A mixture of lignite, limestone and SPL in an appropriate proportion has proven to notably increase the agglomeration temperature of the ash, allowing this low-melting waste to be destroyed continuously by FBC. Ash leachate character is modified by control of ash chemistry to ensure that fluoride anions and metallic cations are at or below acceptable limits.

8 Claims, 1 Drawing Sheet

FLUIDIZED BED COMBUSTION OF ALUMINUM SMELTING WASTE

This Application is a division of application Ser. No. 07/242,526 filed Sep. 8, 1988, now abandoned.

REFERENCES CITED

| U.S. PAT. DOCUMENTS | | |
|---|---|---|
| 2,858,198 | 10/1958 | J. P. McGeer et al. |
| 3,077,382 | 2/1963 | G. I. Klein et al. |
| 3,102,792 | 9/1963 | D. K. Eads et al. |
| 3,930,800 | 1/1976 | Schoener et al. |
| 4,103,646 | 1/1978 | Yerushalmi et al. |
| 4,334,898 | 6/1982 | Zhuber-Okrog et al. |
| 4,579,070 | 4/1986 | Lin et al. |
| 4,763,585 | 8/1988 | Rickman et al. |

BACKGROUND OF THE INVENTION

Sound management of Spent Potliner (waste from the production of primary aluminum by the electrolytic process known as the Hall-Heroult process) has been an issue of concern for governmental regulatory agencies and industry alike. Spent Potliner is known to be contaminated with large amounts of harzardous materials (cyanide and fluorine). Heating value for this waste varies from 3000 to 5000 BTU per pound. The quantity of Spent Potliner generated and discarded annually in the United States alone, has exceeded 200 thousand tons. In addition, over 1,200 thounsand tons are presently found in recoverable storage, awaiting a final destiny, and much more yet festering in landfills. Because of its high concentrations of fluorine and cyanide, Spent Potliner was recently listed as "hazardous" (EPA hazardous waste # K088, Sep. 13, 1988).

Several management alternatives to land-based disposal of Spent Potliner have been suggested. Among them, some are considered "disposal techniques" such as using Spent Potliner as a fluorspar substitute in iron-melting and steel making, or as fuel in cement manufacture or fluidized bed combustion. Others have "recovery techniques" such as recovery of cryolite, molten salt recovery of chemical and energy values, pyrohydrolysis, and pyrosulfolysis. However, the complexity, cost disposal of residuals, and engineering problems of most of these processes make them economically unacceptable. Accordingly, landfilling and stockpiling are still the only practical and feasible alternative.

The most promising solution to management of this waste stream is fluidized bed combustion. During the last decade, fluidized bed combustion has been widely adopted for burning high-sulfur fuel and has gained commercial acceptance for the disposal of a growing number of hazardous materials. The advantages of this process are well established: high turbulence and residence time of the waste in the combustion chamber allow complete combustion at a moderate temperature (850° C).

A number of attempts at incinerating Spent Potliner by fluidized bed combustion have been made. However, those systems exhibited extreme operating difficulties primarily due to the formation of clinkers and agglomeration of the ash, off-gas (HF) emission control, ash-fluoride leachate control, and heavy metal leachate control. Agglomeration causes segregation and defluidization, consequently shutdown of the process. Emission and leachate control directly influence the short and long-term environmental consequences from the process and therefore the overall process feasibility.

Management of Spent Potliner has been subject to U.S. Pat. #2,858,198 published in Oct. 28, 1958. This invention involves recovery of fluorine from Spent Potliner by distillation. In that disclosure, coarse pieces of Spent Potliner are heated in a furnace to over 1000° C. under sub-atmospheric pressure, thereby volatilizing fluorides. Processes involving fluidized beds have also been subject to many U.S. patents, e.g. combustion of sulfur-containing fuel by Pat. #4,103,646 and #4,579,070; recovery of sulfur from native ores by volatilization of the free sulfur from the ore (U.S. Pat. No. 3,102,792); desublimation of gaseous aluminum chloride to solid form (patents #3,930,800 and #4,334,898); sublimation of phosphoric acid anhydride (U.S. Pat. No. 3,077,382). None of these processes disclose an application of fluidized bed combustion technology to Spent Potliner, nor the introduction of property additives to control agglomeration. U.S. Pat. No. 4,763,585 does address the fluidized bed combustion of Spent Potliner. In that disclosure a physical coating is applied to the Spent Potliner in order to reduce the stickiness of the particle at operating temperatures. That is achieved exclusively by physical means by coating tacky particles with any of various inert fine powders to reduce the stickiness; almost any dirt will serve.

In the process revealed by this application, ash chemistry is regulated—with additive—for three purposes: 1. To chemically create a non-sticky compound, within and on the surface of Spent Potliner and ash particles, that does not display an adhesive tendency and form agglomerates. 2. To reduce to a minimum the leachate conscentration of fluoride anion and metal cations from ash samples removed from the process and subjected to standard leach procedures. 3. To minimize hydrogen fluoride emissions in-situ prior to subsequent off-gas treatment by chemically reacting HF out of the gas stream.

The primary cause of agglomerate formation while firing fuel blends that include Spent Potliner is due to the composition of Spent Potliner itself. Alkali-halide compounds in Spent Potliner—thought of as impurities—form a low-melting eutectic at fluidized bed combustion temperatures that behaves as a glue and causes a tendency for the ash to agglomerate.

In addition to the problem of agglomeration, control of both off-gas emissions and residual-ash leachate concentrations must be achieved to satisfy regulatory constraints.

A significant contribution to the art would be a complete systems-approach Spent Potliner management alternative, that would be a safe, economical, technically feasible, and an environmentally acceptable process. Such a process is provided by this invention.

SUMMARY OF THE INVENTION

The objective of the invention is to provide a technically-feasible, environmentally-acceptable, and cost-effective solution to the problem of Spent Potliner management. This is done by fluidized bed combustion of Spent Potliner through control of ash chemistry by using specific additives. Several features of the invention can be denoted:

1. Technical feasibility: Modification of ash chemistry increases the ash-melting (fusion) temperature to overcome agglomeration. In other words, an increase in the ash agglomeration temperature from 770° C. to over 900° C. secures continuous fluidized bed combustion operation.

2. Environmental acceptability: Cyanide is completely destroyed at fluidized bed combustion temperatures. Ash chemistry is regulated to minimize fluoride and heavy metal leachate concentrations and reduce gaseous emissions of HF, and other criteria pollutants to accepted values.

3. Cost effectiveness: A significant quantity of energy can be recovered from fluidized bed combustion of Spent Potliner and additives, transforming waste into a valuable asset. In addition, ash modification yields a byproduct that is suitable as an additive in other processes. Notably, the byproduct ash, as an additive in the cement manafacturing process, benefit cement operations.

These aspect—in part or in combination—are claimed as unique in solving technical and economic problems associated with the incineration of Spent Potliner, low-melting materials, or similar wastes by fluidized bed combustion.

DESCRIPTION OF THE INVENTION

Figure 1:
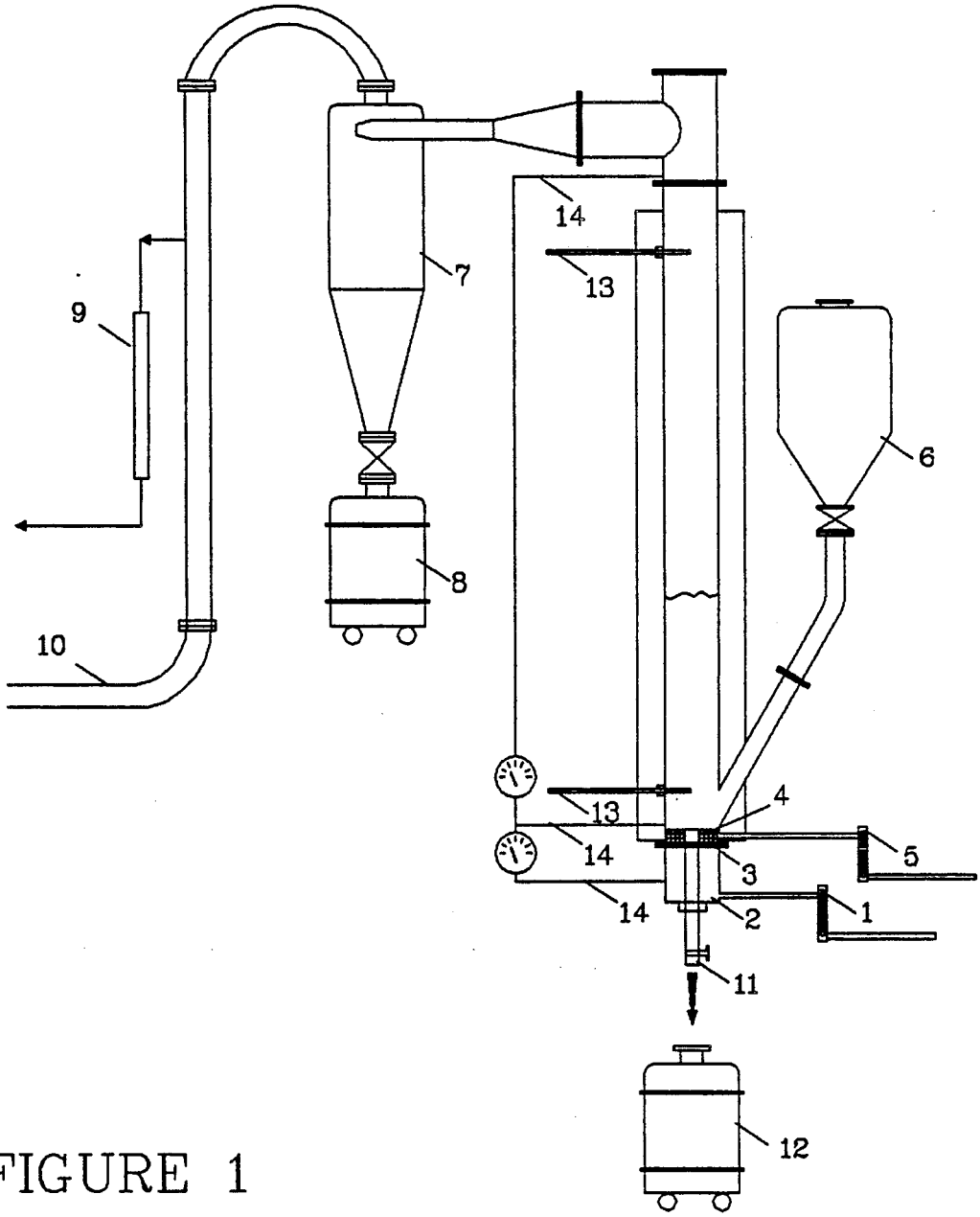
FIG. 1 illustrates a cross-sectional view of a typical fluidized bed combustion reactor which can be used for incinerating Spent Potliner and similar waste.

Mixtures of Rockdale lignite, central Texas limestone, and Alcoa Spent Potliner in proportions ranging from 1:1:1 to 3:1:1 by weight have been used as fuel blend. The variations in ratios depend upon the relative component concentrations in the feed streams, which vary widely.

EQUIPMENT

Experiments were performed in a 15 cm diameter, 210 cm high atmospheric Fluidized Bed Combustor configured for continuous operation at a feed rate of 10 kg/hr. The insulated reactor and most components of the plant were constructed of 309 stainless steel. The major components of the installation are illustrated in FIG. 1. The air required for combustion and fluidization was supplied volumetrically via rotameter 1 and distributed homogeneously through the typical 30 cm bed via a windbox 2 and a perforated plate 3 covered with alumina balls 4. Methane was also supplied volumetrically via rotameter 5 and used for preheating the bed to 700° C., which was generally sufficient to ignite the reactive fuel blend.

Fuel blends were premixed and placed in an airtight hopper 6 prior to injection into the combustion chamber at a height of 5 cm above the distributor plate 3. Flue gas entered a cyclone 7; where entrained particles were collected in a flyash receiver 8 for analysis and disposal. The exhaust from the cyclone was introduced either to the sampling line 9 for analysis or directly to a waste gas manifold 10.

Bed solids were intermittently via a central 4 cm drain 11 to maintain constant bed height. Samples were collected routinely in a bottom ash receiver 12 for analysis and disposal. Temperature and pressure were measured in the reactor by thermocouples 13 and pressure taps 14.

PROCESS

The initial bed material (solid support) can be either inert sand or spent lignite ash. The initial bed material is pre-heated by a startup gas burner. When the bed temperature reaches 700° C., fuel blend consisting and limestone in a ratio ranging from 1:1 to 3:1 is fed; the gas burner can be turned off. This fuel blend is continuously fed—initially without Spent Potliner—until an ash inventory turnover of at least one bed volume is present. The time required to allowing one volume turnover is computed as $t=v/v'$, where v is the bed volume and v' is the volumetric feeding rate. Prior to introducing Spent Potliner, the bed temperature is raised from 700° C. to a minimum of 850° C. It is critical that an inventory of spent sulfur-rich ash be present to introduction of Spent Potliner in order that sufficient chemical reaction mixtures are present.

MODIFICATION OF ASH CHEMISTRY

A proportion of lignite versus Spent Potliner ranging from 1:1 to 3:1 has proven the ability to increase considerably the agglomeration temperature of the ash. A jump from 770° C. to 950° can be expected. Without additive, bed solids started to agglomerate at 770° C. It is believed that a high concentration of sulfur in the lignite ash (usually over 10%, expressed as $SO_3$) plays a key role in the process. The presence of sulfur trioxide tends to promote formation of sodium sulfate which has a relatively high melting point, thus increasing the ash-fusion temperature of the resulting ash.

These in-situ reactions can be described as:

$$C(NaF)+O_2 \rightarrow CO_2+NaF(s)$$

$$2NaF+SO_3+H_2O \rightarrow Na_2SO_4(s)+2HF(g)$$

which is thermodynamically favorable at the fluidized bed combustion operating temperatures. $H_2O$ can be found in abundance in the moisture of blend. These reactions make Na sites, the cause of agglomeration, unavailable. These reactions also explain the technique of postponing Spent Potliner introduction until there is a one-bed-volume inventory of lignite ash present, as presented above, in which $SO_3$ concentration in the bed is the determinant factor controlling the bed ash-fusion temperature increase.

Lignite (or similar fuel) is used as both fuel additive (for its energy content) and as a chemical additive (for its constituents that occupy sodium sites). Limestone control gaseous emissions (HF and $SO_2$) and transforms fluoride and metals to non-leachable forms.

Fluoride concentration in both water and acid leachates, derived from ash residues, decreases sharply with Ca/F molar ratio. By increasing from 0 to 0.4 limestone/Spent Potliner weight ratio (which corresponds to 0 to 0.4 Ca/F molar ratio), a decrease in fluoride concentration from 105,000 ppm (10.5%) to 8 ppm is noted.

Increasing the molar ratio of calcium to fluorine lowered HF emission. The capture of HF by limestone can be described simply as:

$$CaCO_3 \xrightarrow{850^\circ C.} CaO + CO_2$$

$$CaO + 2\,HF \longrightarrow CaF_2 + H_2O$$

HF emissions decreases more or less linearly with increasing Ca/F molar ratio. This is not surprising for a diffusion limited process in which the reaction rate is proportional to the availability of CaO reactive sites. The high lime requirements (1:1 weight ratio with Spent Potliner) for control of fluoride ion leachability implies, as an ineluctable consequence, excellent HF emission control. Metals concentration in the ash leachate are well below RCRA standards. (Lime is thought to play a role in immobilizing metals). Cyanide molecular bonds are thermally broken at 850° C. rendering it destroyed to completion.

ASH BYPRODUCT

Byproduct ash from the process may have several destinies. During combustion, fluorine ions are tied-up in a solid form ($CaF_2$), which has very low solubility and is safe for landfilling. Criteria heavy metals (As, Ba, Cd, Cr, Pb, Hg, Se, Ag, Ni, V) are tied-up or of such low concentration that they are at or below the limits of detectability in the leachate. The ash generated through application of this process has value as a commercially-viable byproduct, notably as an additive in cement manufacturing. Byproduct ash as an additive in cement manufacturing presents several benefits:

1. Fuel Savings: The clinker formation temperature (kiln operating temperature) is lower with the ash as an additive.

2. Increased Product Throughput: Ash as additive accelerates clinker formation and calcination reactions, thereby more product can be made per unit of fuel consumed.

3. Heat Duty Reduced: Limestone from the fluidized bed combustor is precalained prior to kiln entry further lowering the energy requirement.

4. Fluoroaluminate content: The high fluoride and alumina content of the ash provided allows the cement manufacturer to take advantage of the fluoroaluminate phase for cement with high early-strength development (regulated set cement).

The claims are not limited to lignites coal but includes any similar solid fuels, liquid fuels, slurries, suspensions, waste fuels, and gaseous fuels with or without admixture of additives to promote control of emissions, suppress agglomeration, or modify ash chemistry for leachate and emission controls.

The claims are not limited to the ash present in lignite or coal but may include sulfur-bearing materials or other mineral substances to chemically promote a high ash-fusion temperature in the resulting bed.

The claims are not limited to limestone addition only but includes any similar substances such as dolomite, oyster shells, coral, or any calcium-rich or magnesium-rich substances.

The ratios of Lignite to Spent Potliner and Spent Potliner to limestone are not constrained.

It will be understood that the features of this invention are not only applied to combustion of Spent Potliner but also to similar low-melting eutectic-forming materials in a.

The claims are not constrained to any style of fluidized bed but encompasses bubbling beds, internally or externally recirculating beds, atmospheric fluidized beds, pressurized fluidized beds, rotating and revolving fluidized beds. The claims are not constrained to fluidized beds exclusively but include tumbling beds, rotary kilns, cement kilns, multiple hearths or any similar furnace or incinerator.

It is to be understood that all matters shown in this disclosure are to be intepreted in an illustrative and not in a limiting sense.

We claim

1. An thermo-chemical process for consuming Spent Potliner and the contaminant compounds present in Spent Potliner, the process comprising:

granulating a fuel blend of a lignite, b. limestone, and c. Spent Potliner, in proportions ranging from 1:1:1 to 3:1:1;

burning the granulated mixture in a fluidized bed combustor at a temperature of from 800° C. to 1000° C.;

chemically forming a free-flowing ash from the consumed mixture.

2. A process, as recited in claim 1, in which the fluidized bed temperature is increased to the working temperature (850° C. or greater) after at least one bed volume of fuel blend has been fed.

3. A process, as recited in claim 1, in which sodium (alkali) sites present in Spent Potliner are occupied by in-situ reaction products, thereby inducing chemical and structural modifications in the ash that allow an increase in the agglomeration temperature threshold.

4. A process, as recited in claim 1, in which gaseous emissions of HF and $SO_2$ evolved from combustion of fuel blend are controlled to low levels by chemical means.

5. A process, as recited in claim 1, in which cyanide present in Spent Potliner is completely destroyed thermally.

6. A process, as recited in claim 1, in which fluoride and heavy metals concentrations in ash leachate are minimized by chemical means.

7. A process, as recited in claim 1, in which the free-flowing granular ash is benign and safe for disposal in an appropriate landfill or suitable as an extender in cement manufacturing.

8. A process, according to claim 1, which allows recovery of thermal energy from processing.

* * * * *